US009107803B2

(12) United States Patent
Vaught

(10) Patent No.: US 9,107,803 B2
(45) Date of Patent: Aug. 18, 2015

(54) CONTAINER WITH STORAGE CHAMBERS

(71) Applicant: Ricky Lee Vaught, Belleville, IL (US)

(72) Inventor: Ricky Lee Vaught, Belleville, IL (US)

( * ) Notice: Subject to any disclaimer, the term of this patent is extended or adjusted under 35 U.S.C. 154(b) by 272 days.

(21) Appl. No.: 13/759,321

(22) Filed: Feb. 5, 2013

(65) Prior Publication Data

US 2013/0200028 A1 Aug. 8, 2013

Related U.S. Application Data

(60) Provisional application No. 61/595,108, filed on Feb. 5, 2012.

(51) Int. Cl.
*A61J 9/00* (2006.01)
*A61J 1/20* (2006.01)

(52) U.S. Cl.
CPC ..... *A61J 9/008* (2013.01); *A61J 1/2093* (2013.01)

(58) Field of Classification Search
CPC ..... B65D 1/04; B65D 51/28; B65D 23/12; A61J 9/00; A47G 19/2205; B05C 17/0106
USPC ..... 215/6, 11.3, 252, 11.1, 211, 11.2; 220/4.01; 206/222, 221, 219, 223; 222/80, 83
See application file for complete search history.

(56) References Cited

U.S. PATENT DOCUMENTS

| | | | | |
|---|---|---|---|---|
| 3,747,414 | A * | 7/1973 | Ohno | 73/428 |
| 5,542,922 | A * | 8/1996 | Petterson et al. | 604/77 |
| 5,794,802 | A * | 8/1998 | Caola | 215/11.1 |
| 5,897,007 | A * | 4/1999 | Schein et al. | 215/11.1 |
| 5,950,689 | A * | 9/1999 | Varlet | 141/22 |
| 6,484,897 | B1 * | 11/2002 | Crawley | 215/307 |
| 8,151,985 | B2 * | 4/2012 | Owoc | 206/219 |
| 8,167,155 | B2 * | 5/2012 | Hsieh | 215/6 |
| 8,596,480 | B2 * | 12/2013 | Arjomand | 220/4.01 |
| 2008/0061764 | A1 * | 3/2008 | Tae et al. | 324/72 |
| 2008/0314775 | A1 * | 12/2008 | Owoc | 206/222 |

* cited by examiner

*Primary Examiner* — Fenn Mathew
*Assistant Examiner* — Cynthia Collado
(74) *Attorney, Agent, or Firm* — Douglas E. Warren

(57) ABSTRACT

A container having at least two separate chambers that allow for the storage of two components of a liquid product to be stored, and later mixed, for consumption wherein the storing or mixing takes place within the container and is allowed by placement of a formula chamber disposed at various positions with the container.

18 Claims, 4 Drawing Sheets

CONTAINER WITH STORAGE CHAMBERS

CROSS REFERENCE TO RELATED APPLICATIONS

This application claims the benefit of U.S. Provisional Application No. 61/595,108 filed on Feb. 5, 2012. The entire disclosure of that application is incorporated by reference into the disclosure of this document is if fully stated herein.

STATEMENT REGARDING FEDERALLY SPONSORED RESEARCH

Not applicable.

FIELD OF THE INVENTION

This disclosure relates to the field of storage chambers, and more specifically to storage containers in which the container can store a powdered component and a liquid component within separate chambers of a container wherein the container includes components that allow the powdered component to be combined later with the liquid component to generate a final product that comprises the mixture of the powder and the liquid.

BACKGROUND OF THE INVENTION

This section provides general background information related to the present disclosure. This background information is not necessarily prior art.

It is common to generate solutions that begin as two separate components such as a dry powder component and a liquid component. In most cases, the final solution is generally made when the dry powered is mixed and dissolved into the liquid component. Such products include infant formulas for infant feeding and protein drinks used as health products. In each case, there are two major components that originally exist as a separate powder and a separate liquid. The popularity of such products has increased dramatically over the past few years with the most predominant application being in the generation of infant liquid formula fed to an infant from to a bottle.

A common characteristic of such products is that the powdered component must be kept separate from the liquid component until such time as the product is to be used. This means the powder component is normally purchased in bulk and temporarily stored in a container separate from the container used for final delivery of the mixture. While the generation and preparation of the final product is a simple mixing of the powdered component with the liquid component, there are circumstances where it is inconvenient for the user to retain possession of a large bulk supply of the powder and a large supply of the liquid dissolving component.

Therefore, there is a need to provide a simple and portable container that includes the correct amount of the powdered component and the correct amount of dissolving liquid component where those two components can be quickly and easily combined within the container itself to prepare the final product desired by the user.

SUMMARY OF THE INVENTION

This section provides a general summary of the disclosure, and is not a comprehensive disclosure of its full scope or all of its features.

In accordance with the various embodiments of the present invention, this invention relates to an apparatus that simultaneously stores a measured portion of a powdered component and a measured portion of a liquid, and which also includes a system by which the user can later quickly combine the powdered component with the liquid component to generate the final product desired by the user. More specifically, embodiments of the invention include a first storage chamber that allows users to store the powdered component in one area of a container and a second chamber that allows the user to store a liquid component in a second area of the container, thereby keeping the two components separate until needed by the user. The design of the container allows users to mix the powdered component when a feeding is necessary without needing to disassemble any portion of the container to add powdered component to the dissolving liquid.

Further areas of applicability will become apparent from the description provided herein. The description and specific examples in this summary are intended for purposes of illustration only and are not intended to limit the scope or the claims of the present disclosure.

DESCRIPTION OF THE DRAWINGS

In the accompanying drawings which form part of this specification.

Corresponding reference numerals indicate corresponding steps or parts throughout the several figures of the drawings.

Figure 1:
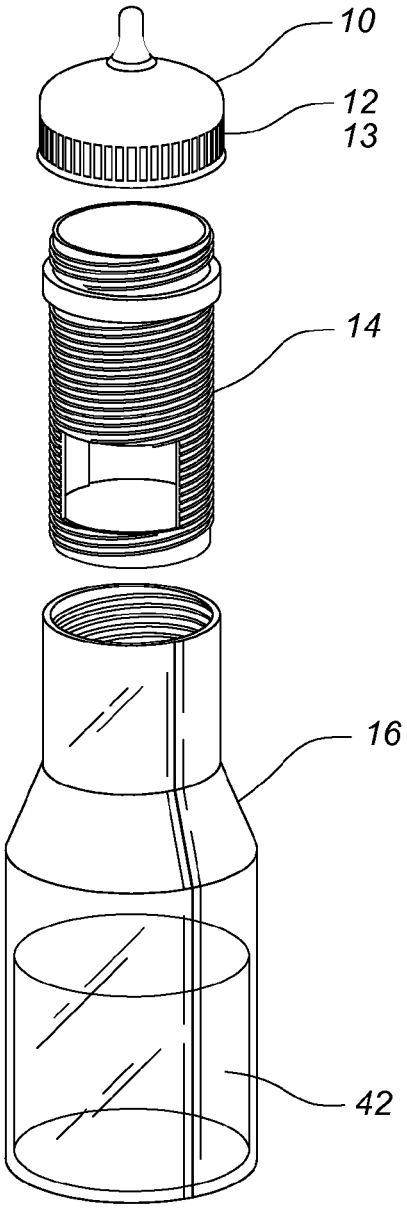
FIG. 1 is an exploded view of one embodiment of the present invention that includes a bottle nipple assembly, a formula chamber, and a bottle base.
Figure 2:
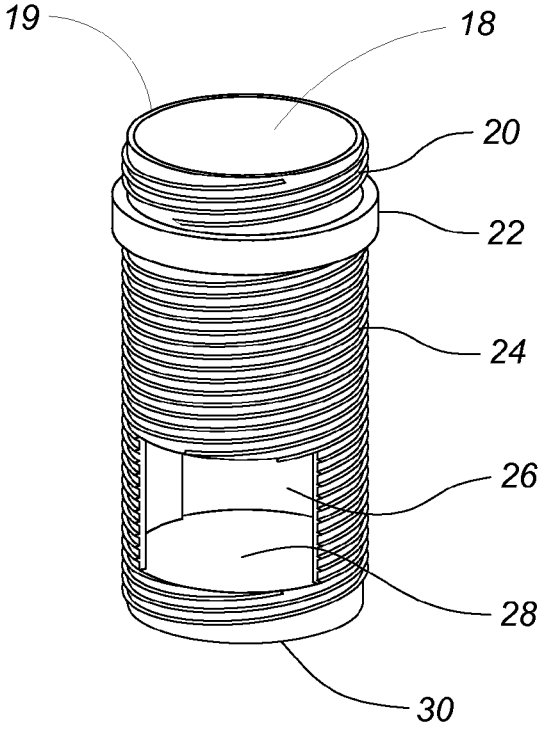
FIG. 2 shows a perspective view of one embodiment of the formula chamber for one embodiment of the present invention.
Figure 3:
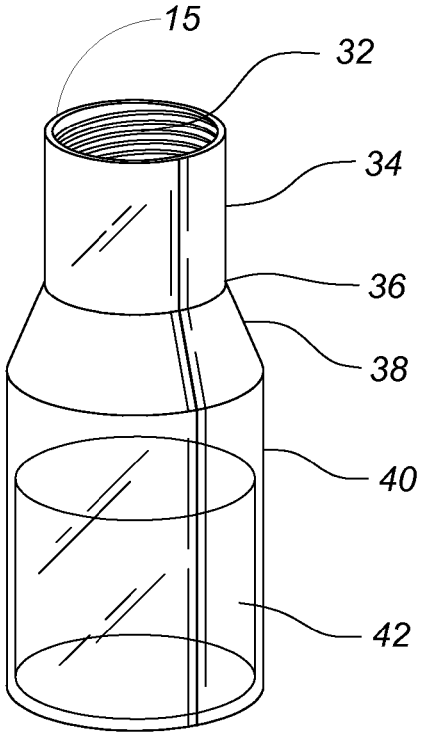
FIG. 3 shows a perspective view of the bottle base for one embodiment of the present invention.

While one embodiment of the present invention is illustrated in the above referenced drawings and in the following description, it is understood that the embodiment shown is merely one example of a single preferred embodiment offered for the purpose of illustration only and that various changes in construction may be resorted to in the course of manufacture in order that the present invention may be utilized to the best advantage according to circumstances which may arise, without in any way departing from the spirit and intention of the present invention, which is to be limited only in accordance with the claims contained herein.

DETAILED DESCRIPTION OF A PREFERRED EMBODIMENT OF THE INVENTION

In the following description, numerous specific details are set forth such as examples of some preferred embodiments, specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill.

A preferred embodiment of the present invention is illustrated in the drawings and figures contained within this specification. More specifically, certain preferred embodiments of the present invention are generally disclosed and described in FIGS. 1-8.

Referring now to FIG. 1, a preferred embodiment of a Container With Storage Chambers A is disclosed. In this embodiment, the Container With Storage Chambers A is adapted for use as an infant bottle. This embodiment includes a bottle nipple 10, a formula chamber 14, and a bottle base 16. The bottle nipple 10 comprises a bottle nipple ring 12 wherein the nipple ring includes a set of nipple ring internal threads 13. In the various operations of the present embodiment, the bottle nipple 10 is mounted onto the formula chamber 14, and the formula chamber is disposed within the bottle base 16 by engaging the external threads 24 of the formula chamber with the internal threads 32 of the bottle base. It is understood that in other embodiments where the present invention is adapted for use as a mixing container for protein powders, the bottle nipple ring 12 can be replaced with a cap configured to seal the bottle base 16 until needed by a user. As will be seen below, the vertical position of the formula chamber 14 in relation to the bottle base 16 will be indicative of whether the present embodiment is in a storage configuration or an operation configuration.

The formula chamber 14 (FIG. 2) is generally cylindrical in shape and includes a set of formula chamber top threads 20 disposed on a proximal end 19 of the formula chamber, a set of formula chamber bottom threads 24 disposed on a formula chamber bottom 30 of the formula chamber 14, and a formula chamber ring 22 located between the formula chamber top threads and the formula chamber bottom threads. The formula chamber top threads 20 are sized and configured to operationally match a set of nipple ring internal threads 13 of the bottle nipple ring 12. The formula chamber 14 includes a formula chamber cutout 26. The formula chamber cutout 26 in the present embodiment is generally cylindrical in shape with the formula chamber and includes a formula chamber opening 18 that opens at the proximal end 19 of the formula chamber 14, and a formula chamber floor 28 near the formula chamber bottom 30. It is understood that the axis of the formula chamber opening 18 is generally in coaxial alignment with the axis of the formula chamber 14 and the formula chamber floor 28. While the formula chamber opening 18 of the present embodiment is generally cylindrical, it will be appreciated by those of skill in the art that in other embodiments the formula chamber opening may be in other shapes. For example in other embodiments, the formula chamber opening may be in the shape of one of either a quadrilateral, square, rectangle, oval, or any other geometric shape as long as the geometric shape selected is capable of allowing the Container with Storage Chambers A to store a sufficient amount of powder formula 44 and then allow that powder formula to move from the formula chamber opening 18 to the water 42 to allow the powder formula to mix with the water. It will be appreciated that a sufficient amount of water and powder formula means the amount of water and powder formula necessary to achieve the proper proportions and mixture the user desires the final product to have.

It is noted that in the present embodiment, there is a distance "A" (FIG. 7) between the formula chamber floor 28 and the formula chamber bottom 30. It is understood that the distance A controls the amount of thread engagement between formula chamber bottom threads 24 and the bottle base internal threads 32. Thus, the greater the distance A, the more there is thread engagement between formula chamber bottom threads 24 and the bottle base internal threads 32. It will be appreciated that the distance A must be sufficient to allow enough thread engagement between the formula chamber bottom threads 24 and the bottle base internal threads 32 to inhibit the powder formula 44 from moving from the formula chamber cutout 26 into the water 42 within the bottle base liquid chamber 40 when the Container with Storage Chambers A is oriented in its storage position. In a preferred embodiment, the distance A is between about 0.25 inch and about 1.00 inch.

Figure 7:
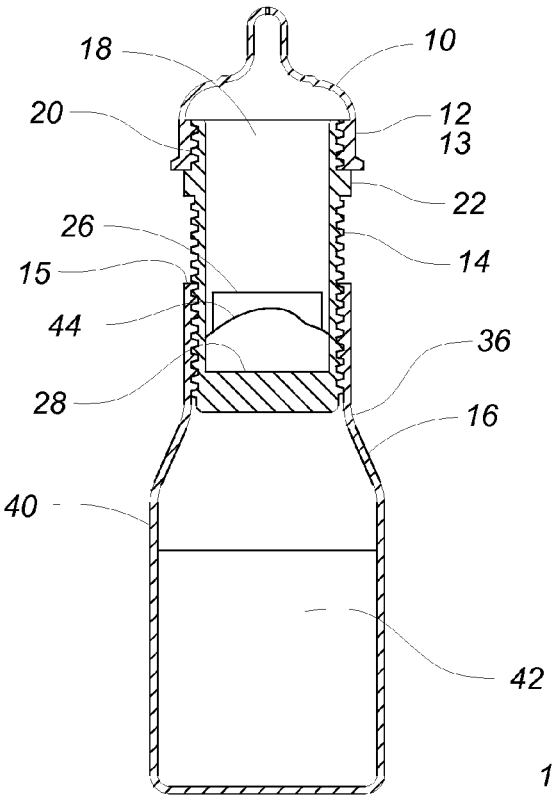
FIG. 7 is a vertical cross section of one embodiment of the present invention and related to FIG. 5 to disclose the general orientation of the bottle nipple, the formula chamber and the bottle base during storage of the powdered formula and the water.
Figure 8:
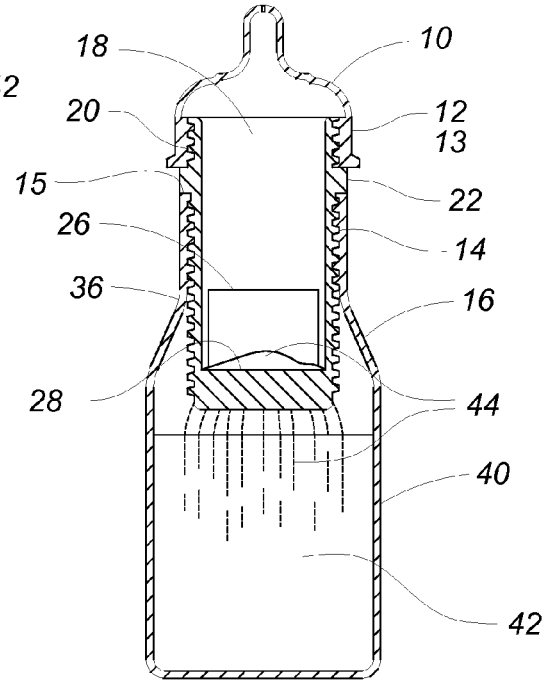
FIG. 8 is a vertical cross section of one embodiment of the present invention and related to FIG. 6 and discloses the orientation of the bottle nipple, the formula chamber and the bottle base when the formula chamber has been screwed into the bottle base to allow the powdered formula to move from the formula chamber and into the water.

The formula chamber ring 22 resides circumferentially around the outer surface of the formula chamber 14 and is in axial alignment with the formula chamber. The formula chamber ring 22 in the present embodiment has a greater outside diameter than the outside diameters of the formula chamber top threads 20 and the formula chamber bottom threads 24. In the present embodiment, the formula chamber ring 22 acts to prevent the user from inserting the formula chamber 14 to far into the bottle base 16. This is to say, when a user rotates the formula chamber 14 to engage the bottle base internal threads 32 to move the formula chamber into the bottle base 16, the formula chamber ring 22 will contact the upper edge 15 (FIG. 3) of the bottle base 16 (FIG. 7) as shown in FIG. 8 to prevent the formula chamber from being further inserted into the bottle base.

In alternative embodiments, the formula chamber ring 22 does not have a greater diameter than the formula chamber top threads 20 or the formula chamber bottom threads 24. Instead, the formula chamber ring has an outside diameter less than either the formula chamber top threads 20 or the formula chamber bottom threads 24. In this alternative embodiment, the formula chamber ring 22 further includes indicia on the ring that indicates to the user whether the formula chamber 14 has been inserted into the bottle base 16 to reside at a position in which the powder formula 44 is stored within the formula chamber opening 18 without allowing the formula powder to move from the formula chamber opening and into the water 42 residing in the bottle base liquid chamber 40 as shown in FIG. 7. Additionally, the present alternative embodiment also includes indicia on the formula chamber ring 22 that indicates to the user whether the formula chamber 14 has been inserted into the bottle base 16 to reside at a position in which the powder formula 44 has been released from the formula chamber opening 18 such that the powder formula 44 is released into the water 42 residing in the bottle base liquid chamber 40 as shown in FIG. 8.

The bottle base 16 (FIG. 3) comprises the upper edge 15, a set of bottle base internal threads 32, a formula chamber staging chamber 34, a formula chamber staging chamber bottom 36, and the bottle base liquid chamber 40. The bottle base internal threads 32 are sized and configured to operationally match the formula chamber bottom threads 24. In the current embodiment, the bottle base 16 includes a bottle base expansion 38 that is disposed between the formula chamber staging chamber 34 and the bottle base liquid chamber 40. It is understood that the set of bottle base internal threads 32, the formula chamber staging chamber 34, the formula chamber staging chamber bottom 36, the bottle base expansion 38, and the bottle base liquid chamber 40 are substantially in axial alignment. It is also understood that, in the present embodiment, the formula chamber staging chamber 34 has a smaller outside diameter than the outside diameter of the bottle base liquid chamber 40. Finally, in the present embodiment, the bottle base expansion 38 has an outside diameter at its top end that is the same as the outside diameter of the formula chamber staging chamber 34, while the bottle base expansion has an outside diameter at its bottom end that is the same as the outside diameter of the bottle base liquid chamber 40.

In operation, the Container with Storage Chambers A includes two primary modes. The first mode is a storage mode wherein the bottle base 16 has the water 42 residing in its bottle base chamber 40 and wherein the powder formula 44 is residing within the formula chamber opening 18 such that the powder formula is inhibited from moving into the water 42. The second mode is an in-use mode wherein the formula chamber 14 has been inserted into the bottle base 16 such that formula chamber bottom 28 is lower than a formula chamber staging chamber bottom 36 thus allowing the powder formula 44 to move into the water 42 for mixing with the water. Each of these two modes is more fully described in the following.

Figure 4:
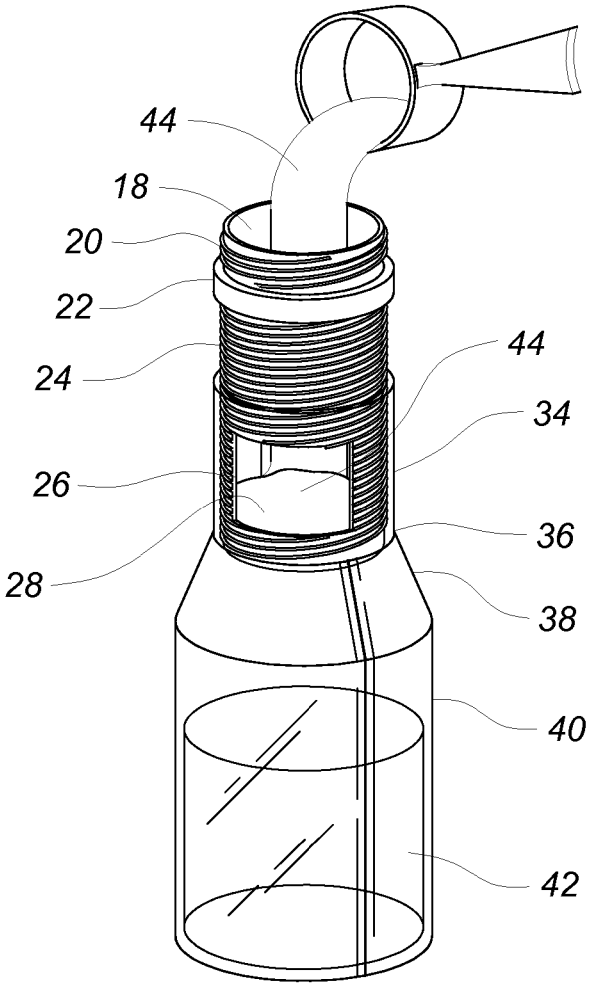
FIG. 4 shows a perspective view of one embodiment of the present invention to disclose the general positioning of the formula chamber within the bottle base during the process of loading a powdered portion into the formula chamber.
Figure 5:
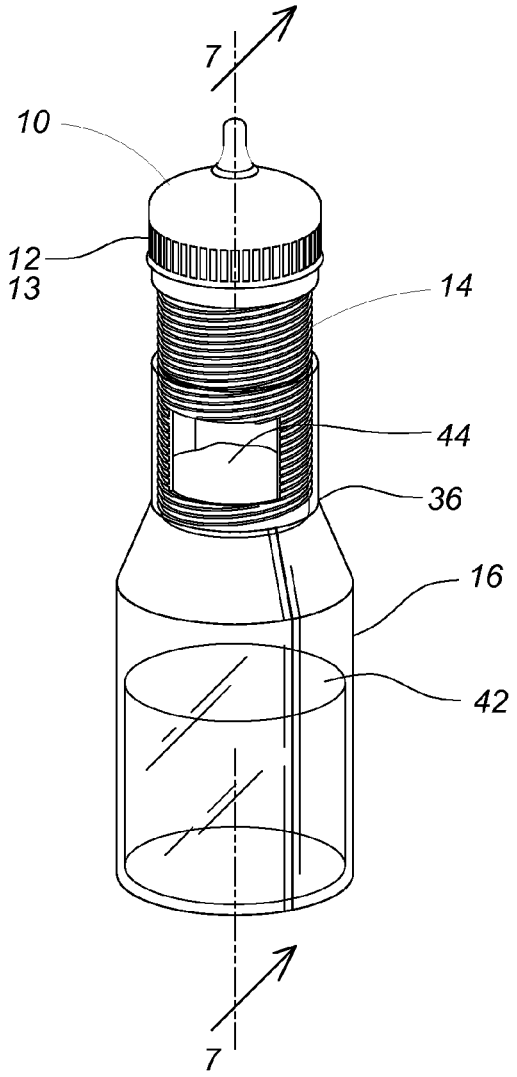
FIG. 5 is a perspective view of one embodiment of the present invention and discloses the general orientation of the bottle nipple, the formula chamber and the bottle base during storage of the powdered formula and the water.

Referring now to FIGS. 4, 5, and 7, in the first mode, the user removes the formula chamber 14 from the bottle base 16. The user then places a sufficient amount of water 42 into the bottle base liquid chamber 40 of the bottle base 16 and reinstalls the formula chamber 14 into the bottle base 16. Before placing any formula powder 44 into the formula chamber 14, the formula chamber 14 is withdrawn from the bottle base 16 by rotating the formula chamber so as to disengage the formula chamber bottom threads 24 from the bottle base internal threads 32 until the user is sure that the formula chamber bottom 30 is located above the formula chamber staging chamber bottom 36 of the bottle base 16. The user then places a sufficient amount of the powder formula 44 onto the formula chamber floor 28 by inserting the powder formula into the formula chamber opening 18 and allowing the powder formula to rest on the formula chamber floor and within the formula chamber cutouts 26. When the sufficient amount of powder formula 44 has been placed within the formula chamber 14, the bottle nipple 10 and bottle nipple ring 12 are installed onto the top end of the formula chamber 14 by engaging the bottle nipple internal threads 13 with the formula chamber top threads 20. The Container with Storage Chambers A is now in its storage mode and is ready for later mixing of the water 42 and formula powder 44 by the user.

Figure 6:
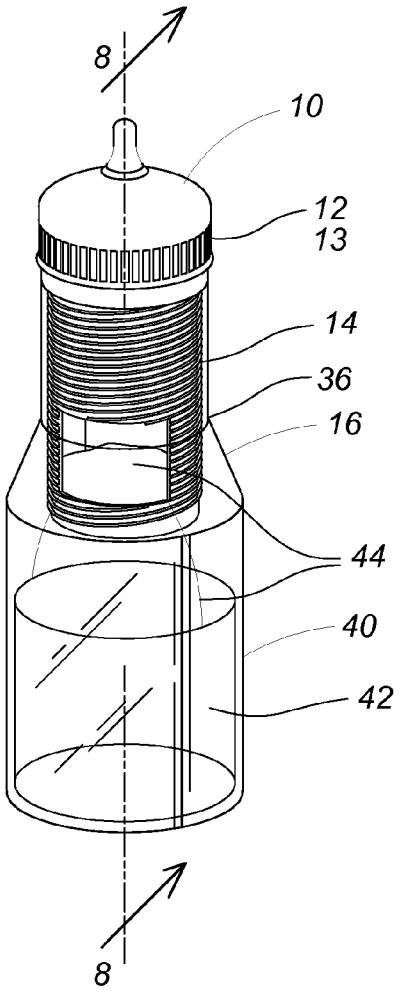
FIG. 6 is a perspective view of one embodiment of the present invention and discloses the orientation of the bottle nipple, the formula chamber and the bottle base when the formula chamber has been screwed into the bottle base to allow the powdered formula to move from the formula chamber and into the water.

Referring now to FIGS. 6 and 8, in the second mode, the user changes the Container with Storage Chambers A from its storage mode into its operational mode. To do so, the user rotates the formula chamber 14 as needed to cause the formula chamber to be further inserted into the bottle base liquid chamber 40 of the bottle base 16. As the formula chamber 14 moves further into the bottle base liquid chamber 40, a point will be reached where the formula chamber floor 28 will become lower than formula chamber staging chamber bottom 36, and that will begin to allow the powder formula 44 to move from the formula chamber floor 28 and into the water 42 within the bottle base liquid chamber 40. As the formula chamber 14 is further inserted into the bottle base 16, the formula chamber floor continues to move downward until all of the powder formula 44 has moved from the formula chamber cutout 26 and into the water 42. When the powder formula 44 has been fully dispersed into the water 42, the user ceases rotation of the formula chamber 14. Then, depending on the powder formula 44 used and the water 42 used, the user may feed the product to an infant by allowing the infant to suck on the bottle nipple, or if the powder formula 44 and the water 42 need assistance on becoming a homogeneous solution, the user may shake the Container with Storage Chambers A until the formula powder and water are sufficiently mixed. In alternative embodiments, the bottle nipple 10 would not be used and a person would simply drink the product from the Container with Storage Chambers A, or pour the product from the Container with Storage Chamber into another container for drinking.

In the present embodiment, it is preferred that the formula chamber 14 and bottle base 16 be manufactured using a plastic injection molding process, however, any other manufacturing process may also be used as long as the configuration and function of the embodiment, and the components of the embodiment, are found in the end item Container With Storage Chambers A. For example, the preferred embodiments may also be made from either polypropylene, polyethylene, or any plastic engineering resins that are acceptable for use by the United States Food and Drug Administration.

In the preceding description, numerous specific details are set forth such as examples of specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication and manufacture for those of ordinary skill. The scope of the invention should be determined by any appended claims and their legal equivalents, rather than by the examples given.

Additionally, it will be seen in the above disclosure that several of the intended purposes of the invention are achieved, and other advantageous and useful results are attained. As various changes could be made in the above constructions without departing from the scope of the invention, it is intended that all matter contained in the above descriptions or shown in the accompanying drawings shall be interpreted as illustrative and not in a limiting sense.

Terms such as "proximate," "distal," "upper," "lower," "inner," "outer," "inwardly," "outwardly," "exterior," "interior," and the like when used herein refer to positions of the respective elements as they are shown in the accompanying drawings, and the disclosure is not necessarily limited to such positions. Terms such as "first," "second," and other numerical terms when used herein do not imply a sequence or order unless clearly indicated by the context.

When introducing elements or features and the exemplary embodiments, the articles "a," "an," "the" and "said" are intended to mean that there are one or more of such elements or features. The terms "comprising," "including," and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It will also be understood that when an element is referred to as being "operatively connected," "connected," "coupled," "engaged," or "engageable" to and/or with another element, it can be directly connected, coupled, engaged, engageable to and/or with the other element or intervening elements may be present. In contrast, when an element is referred to as being "directly connected," "directly coupled," "directly engaged," or "directly engageable" to another element, there are no intervening elements present. Other words used to describe the relationship between elements should be interpreted in a like fashion (e.g., "between" versus "directly between," "adjacent" versus "directly adjacent," etc.).

What is claimed is:

1. A container comprising:

a bottle base having a set of internal threads and a bottle base liquid chamber; and a formula chamber having a first set of external threads on a proximal end of the formula chamber and a second set of external threads on a distal end of the formula chamber wherein the second set of external threads is sized and configured to operationally engage with the set of internal threads in the bottle base, wherein the formula chamber includes a formula chamber cutout disposed near the distal end of the formula chamber such that when the formula chamber is inserted a first distance into the bottle base, the engagement of the second set of external threads with the internal threads of the bottle base sealingly engages the formula chamber with the bottle base to substantially seal the formula chamber cutout from the bottle base liquid chamber, wherein when the formula chamber is inserted a second distance into the bottle base, the further insertion of the formula chamber into the bottle base allows the formula chamber cutout to communicate with the bottle base liquid chamber of the bottle base to allow any first substance on a formula chamber floor of the formula chamber cutout to mix with any second substance located within the bottle base liquid chamber, wherein the formula chamber is generally cylindrical in shape, and wherein the formula chamber includes a formula chamber opening axially aligned with the formula chamber and which opens at the proximal end of the formula chamber and which ends in the formula chamber floor located near the distal end of the formula chamber.

2. The container of claim 1 further comprising at least one formula chamber cutout in the wall of the formula chamber wherein the formula chamber cutout is located near the distal end of the formula chamber such that a lower edge of the formula chamber cutout is aligned with a surface of the formula chamber floor.

3. The container of claim 2 wherein the formula chamber floor is located between about 0.25 inch and about 1.00 inch from the distal end of the formula chamber.

4. The container of claim 3 wherein the formula chamber opening is generally cylindrical.

5. The container of claim 4 wherein the formula chamber further comprises a formula chamber ring axially aligned with the formula chamber and located between the first set of external threads of the formula chamber and the second set of external threads of the formula chamber wherein the formula chamber ring resides circumferentially around the outer surface of the formula chamber.

6. The container of claim 5 wherein the formula chamber ring has a smaller outside diameter than the outside diameter of the first set of external threads and the second set of external threads of the formula chamber.

7. The container of claim 6 wherein the formula chamber ring further includes an indicia on the formula chamber ring that, in combination with an upper edge of the bottle base, indicates whether the formula chamber has been inserted into the bottle base to reside at a position in which the formula chamber cutout is one of either in communication or not in communication with the bottle base liquid chamber.

8. The container of claim 5 wherein the formula chamber ring has a greater outside diameter than the outside diameter of the first set of external threads and the second set of external threads of the formula chamber.

9. The container of claim 8 wherein the bottle base includes a bottle base expansion having an outside diameter at its top end that is the same as the outside diameter of the formula chamber staging chamber and having an outside diameter at its bottom end that is the same as the outside diameter of the bottle base liquid chamber.

10. The container of claim 9 wherein first set of external threads on the proximal end of the formula chambers is sized and configured to engage with an internal thread of a standard baby bottle nipple ring.

11. The container of claim 10 wherein the formula chamber and the bottle base are manufactured using a plastic injection molding process.

12. The container of claim 11 wherein the formula chamber and the bottle base are manufactured from a material selected from the group that includes polypropylene and polyethylene.

13. A container comprising:

a bottle base having a set of internal threads and a bottle base liquid chamber; and a generally cylindrical formula chamber having;

a first set of external threads on a proximal end of the formula chamber;

a second set of external threads on a distal end of the formula chamber wherein the second set of external threads is sized and configured to operationally engage with the set of internal threads in the bottle base;

wherein the formula chamber includes a formula chamber opening axially aligned with the formula chamber and which opens at the proximal end of the formula chamber and which ends in the formula chamber floor located near the distal end of the formula chamber; and wherein the formula chamber includes at least one formula chamber located near the distal end of the formula chamber such that a lower edge of the formula chamber cutout is aligned with a surface of the formula chamber floor, wherein the formula chamber cutout is disposed near the distal end of the formula chamber such that when the formula chamber is inserted a first distance into the bottle base, the engagement of the second set of external threads with the internal threads of the bottle base sealingly engages the formula chamber with the bottle base to substantially seal the formula chamber cutout from the bottle base liquid chamber, and wherein when the formula chamber is inserted a second distance into the bottle base, the further insertion of the formula chamber into the bottle base allows the formula chamber cutout to communicate with the bottle base liquid chamber of the bottle base.

14. The container of claim 13 wherein the formula chamber floor is located between about 0.25 inch and about 1.00 inch from the distal end of the formula chamber.

15. The container of claim 14 wherein the formula chamber further comprises a formula chamber ring axially aligned with the formula chamber and located between the first set of external threads of the formula chamber and the second set of external threads of the formula chamber wherein the formula chamber ring resides circumferentially around the outer surface of the formula chamber, and wherein the formula chamber ring has a greater outside diameter than the outside diameter of the first set of external threads and the second set of external threads of the formula chamber.

16. The container of claim 15 wherein the bottle base includes a bottle base expansion having an outside diameter at its top end that is the same as the outside diameter of the formula chamber staging chamber and having an outside diameter at its bottom end that is the same as the outside diameter of the bottle base liquid chamber.

17. The container of claim 16 wherein first set of external threads on the proximal end of the formula chambers is sized and configured to engage with an internal thread of a standard baby bottle nipple ring.

18. The container of claim 17 wherein the formula chamber and the bottle base are manufactured using a plastic injection molding process and are made from a material selected from the group that includes polypropylene and polyethylene.

* * * * *